US006052953A

United States Patent [19]

Jewell

[11] Patent Number: 6,052,953

[45] Date of Patent: Apr. 25, 2000

[54] EAVE CONNECTION ASSEMBLY

[76] Inventor: Everett G. Jewell, P.O. Box 397, Dallas, N.C. 28034

[21] Appl. No.: 08/958,097

[22] Filed: Oct. 27, 1997

[51] Int. Cl.[7] ..... E04B 1/19

[52] U.S. Cl. ..... 52/93.1; 52/93.2; 52/643; 52/639; 52/653.1

[58] Field of Search ..... 52/93.1, 93.2, 52/643, 639, 648.1, 690, 653.1, 652.1, 656.1, 656.2; 403/312, 311, 310

[56] References Cited

U.S. PATENT DOCUMENTS

| | | | |
|---|---|---|---|
| 1,738,854 | 12/1929 | Thies | 52/643 |
| 1,958,473 | 5/1934 | Dovell | 52/653.1 |
| 2,010,874 | 8/1935 | Matheny | 52/653.1 |
| 2,067,403 | 1/1937 | Lea | 52/643 |
| 3,862,533 | 1/1975 | Fuss | 52/643 |
| 4,030,256 | 6/1977 | Ollman | 52/93.1 |
| 4,854,104 | 8/1989 | Pomento | 52/643 |
| 5,150,556 | 9/1992 | Yamada et al. | 52/639 |
| 5,454,201 | 10/1995 | Slonim | 52/639 |
| 5,715,642 | 2/1998 | Buers | 52/656.1 |

FOREIGN PATENT DOCUMENTS

| | | | |
|---|---|---|---|
| 213245 | 2/1958 | Australia | 52/690 |

*Primary Examiner*—Carl D. Friedman
*Assistant Examiner*—Phi Dieu Tran A
*Attorney, Agent, or Firm*—Kennedy Covington Lobdell & Hickman, L.L.P.

[57] ABSTRACT

An eave connection assembly for a structural frame for a building which includes a sidewall stud having an outer vertical member and an inner vertical member. The eave connection assembly includes a truss with an end portion that has a generally vertically extending end member and a haunch plate secured to the end portion which has a predetermined vertical extent for attachment to the inner vertical member of the sidewall stud at a selective vertical position. An eave bracket is provided which has a generally vertically extending post having a predetermined vertical extent for attachment to the end member along a portion of the vertical extent of the post, and for attachment to the outer vertical member of the sidewall stud along another portion of the vertical extent of a post at a selective vertical position. An arrangement is provided for attaching the post to the end member of the truss and to the outer vertical member of the sidewall stud at the selective vertical position, and for attaching the haunch plate to the inner vertical member of the sidewall stud at the selective vertical position, to thereby form an eave connection in which the truss and the eave bracket are selectively vertically positioned on the sidewall stud.

23 Claims, 8 Drawing Sheets

EAVE CONNECTION ASSEMBLY

BACKGROUND OF THE INVENTION

The present invention relates generally to the configuration of an eave connection for the structural frame of a building, and more particularly to an assembly for forming an eave connection which can be easily and efficiently assembled and which allows the height of the structural frame to be adjusted in a simple and desirable manner.

The construction of structural building frames through the use of pre-cut and prefabricated components, such as metal studs and trusses, has increased in popularity as the benefits of such building systems have been realized. While metal framing systems have long been used for commercial buildings, such systems are now commonly used for residential buildings, and provide significant advantages in economy, quality, efficiency of use, environmental effects, and resistance to decay and pests.

Metal framing components are typically recyclable, and well over half of the production of steel framing members, for example, is already produced from recycled steel. Pre-cutting and pre-fabrication of structural members significantly reduce in-field waste, and metal framing members experience few problems with varying quality or dimensional inconsistency when compared with wood. Metal framing members are also termite-resistant, do not rot, and provide additional fire safety in that they are non-combustible.

The major structural components of such a structural framing system will typically be pre-cut to length in the factory or assembly shop, and then installed onsite without additional cutting of such components. However, for structural components such as sidewall studs, which are typically anchored on a concrete foundation, the height of the foundation as actually constructed may vary somewhat from the planned height. Thus, if portions of the foundation deviate from the correct height, the pre-cut sidewall studs anchored on such portions of the foundation will also not be located at the correct height if no measures are taken to compensate for the incorrect height of the foundation.

In order to avoid the necessity of on-site cutting or welding of sidewall studs to compensate for improper foundation height, it is known to provide an arrangement which allows the height of the roof truss portion of the structural frame which is attached to the sidewall stud to be adjusted. Ollman U.S. Pat. No. 4,030,256 discloses such an arrangement in which the roof truss includes a downwardly-extending leg at each of its ends, with the leg then being spliced onto the top of the appropriate sidewall stud to support the leg and, thus, the truss. Although not specifically disclosed in the Ollman U.S. Pat. No. 4,030,256 patent, it is known to splice the leg and the top of the sidewall stud in such a way that there is a range of adjustment for the relative position of these two components. For example, the leg and sidewall stud can be spliced together by channels which are of a sufficient length to allow the leg and sidewall stud to be either butted together or separated by a certain distance within the spliced connection, and this range of adjustment, therefore, allows the height of the structural frame, as formed by the roof truss, to also be adjusted somewhat. In this manner, the height of the roof truss can be adjusted to compensate for differing foundation heights or other irregularities.

However, while the construction shown in the Ollman U.S. Pat. No. 4,030,256 patent provides a structural frame having an adjustable height, it does require additional pre-fabrication in that the leg portion must be rigidly attached to the roof truss in order to form the complete component for spliced connection to a sidewall stud at the work site. Transportation of the resulting roof truss/leg structural component is somewhat more difficult due to its increased weight and size. Moreover, assembly of the spliced joint between the sidewall stud and the truss leg requires that these structural components be maintained in precise alignment while the splicing channels are securely fastened.

It is also known to provide eave brackets for attachment to the roof truss of a structural frame system. Such eave brackets typically include a channel member which fits over the top chord of the truss, and the channel member is attached to the top chord by threaded fasteners engaged through the top surface of the channel into the top chord. The heads of such threaded fasteners create irregularities on the top surfaces of the channels mounted on the roof trusses, and thereby prevent the mounting of roof decking materials directly to the roof trusses. Instead, purlins must be installed on the roof trusses to create a set of attachment surfaces generally in the same plane in order to provide for secure mounting of the roof decking thereon. In residential construction, which typically involves the use of plywood roof decking, it would be advantageous if the roof decking could be directly attached to the roof trusses without requiring the use of purlins.

The present invention provides an assembly for forming an eave connection which eliminates the aforesaid limitations of conventional building systems by providing for easy and efficient adjustment of the height of roof trusses and allowing attachment of roof decking without the use of purlins.

SUMMARY OF THE INVENTION

It is accordingly an object of the present invention to provide an assembly for forming an eave connection in which an eave bracket and a truss can be attached to each other and to a sidewall stud in an arrangement which allows the truss and eave bracket to be selectively vertically positioned on the sidewall stud, and in which the eave connection can be easily, efficiently, and rigidly made. It is a further object of the present invention to provide an eave connection which is arranged so as to allow roof decking to be directly attached to the top chord of the roof truss.

Briefly summarized, the present invention accomplishes this objective by providing an assembly for a structural frame for a building which includes a vertically-extending sidewall stud which has an outer vertical member and an inner vertical member, and the assembly comprises a truss which has an end portion including a generally vertically-extending end member and a haunch plate which is secured to the end portion and which has a predetermined vertical extent for attachment to the inner vertical member of the sidewall stud at a selective vertical position. An eave bracket is provided which has a generally vertically-extending post having a predetermined vertical extent for attachment to the end member along a portion of the vertical extent of the post, and for attachment to the outer vertical member of the sidewall stud along another portion of the vertical extent of the post at a selective vertical position. An arrangement is provided for attaching the post to the end member of the truss and to the outer vertical member of the sidewall stud at the selective vertical position, and for attaching the haunch plate to the inner vertical member of the sidewall stud at the selective vertical position, whereby an eave connection can be formed and the truss and the eave bracket can be selective vertically positioned on the sidewall stud.

The truss may include a top chord which extends from the end portion, and the eave bracket may include a top channel formed to engage the top chord in lapping relation, and an arrangement may be included for attaching the top channel to the top chord. The top channel member may further include two downwardly depending flanges for receiving the top chord therebetween, and the arrangement for attaching the top channel to the top chord may fasten the flanges to the top chord. The truss may also include a bottom chord, and the haunch plate may be secured on the top chord and the bottom chord. The top chord may be a channel member having two downwardly-depending flanges, and the haunch plate may be received within the top chord flanges.

In a preferred embodiment, a second haunch plate is secured to the end portion of the truss and has a predetermined vertical extent for attachment to the inner vertical member of the sidewall stud at a selective vertical position. The two haunch plates are mounted in generally parallel spaced relation to define a recess therebetween for receiving the inner vertical member of the sidewall stud therein. An arrangement is provided for attaching the second haunch plate to the inner vertical member at the selective vertical position.

The structural frame may also include a second vertically-extending sidewall stud, and the truss may include a second end portion, with the two end portions being opposed, the second end portion having an end member and a haunch plate secured to a second end portion which has a predetermined vertical extent for attachment to the inner vertical member of the second sidewall stud and a selective vertical position. The eave connection may include a second eave bracket which has a generally vertically-extending post having a predetermined vertical extent for attachment to the end member of the second end portion along a portion of the vertical extent of the post, and for attachment to the outer vertical member of the second sidewall stud along another portion of the vertical extent of the post of the second eave bracket at a selective vertical position. An arrangement may be provided for attaching the post of the second eave bracket to the end member of the second end portion of the truss and to the outer vertical member of the second sidewall stud at the selective vertical position, and for attaching the haunch plate of the second end portion of the truss to the inner vertical member of the second sidewall stud at the selective vertical position, whereby eave connections can be formed and the truss and the eave brackets can be selectively vertically positioned on the sidewall studs.

The structural frame may include a plurality of vertically extending studs spaced and aligned to form a portion of a wall frame for a building, and the eave connection assembly may include a plurality of corresponding trusses and eave brackets for forming a plurality of the eave connections with the sidewall studs. An arrangement is provided for attaching each of the posts of the eave brackets to the end member of the corresponding truss and to the outer vertical member of the corresponding sidewall stud at the selective vertical position, and for attaching the haunch plate of each of the trusses to the inner vertical member of the corresponding sidewall stud at the selective vertical position.

DESCRIPTION OF THE PREFERRED EMBODIMENT

Figure 1:
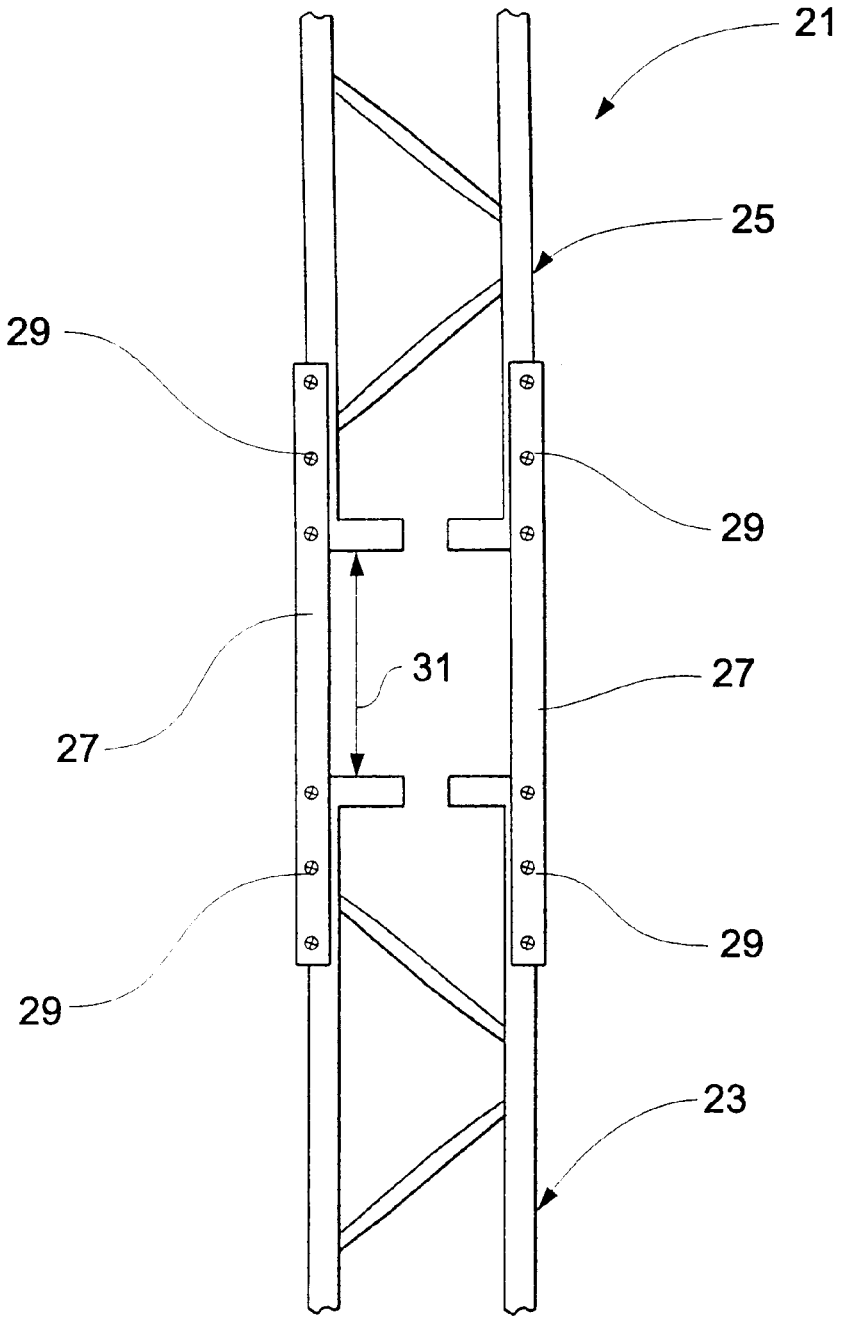
FIG. 1 is an elevational view of a prior art splice connection for a sidewall stud.

Looking now in greater detail at the accompanying drawings, FIG. 1 illustrates a conventional splice connection 21, in which a sidewall stud 23 is connected to a leg 25 of a truss member by splicing channels 27. Threaded fasteners 29 fasten the splicing channels 27 to the sidewall stud 23 and the leg 25.

The conventional splice connection 21 provides a range of adjustability, illustrated by arrow 31, which permits the vertical position of the leg 25 on the sidewall stud 23 to be adjusted so as to compensate for variations in the height of the foundation (not shown) to which the sidewall stud 23 is anchored, or other irregularities. However, use of the conventional splice connection 21 requires that the sidewall stud 23 and the leg 25 be held in precise alignment while the splicing channels 27 are installed, which may be difficult under typical building conditions and also adds time to the construction process. Moreover, if it is desired to add an eave bracket to the structural frame of the building, this must be accomplished in an entirely separate step or arrangements.

Figure 2:
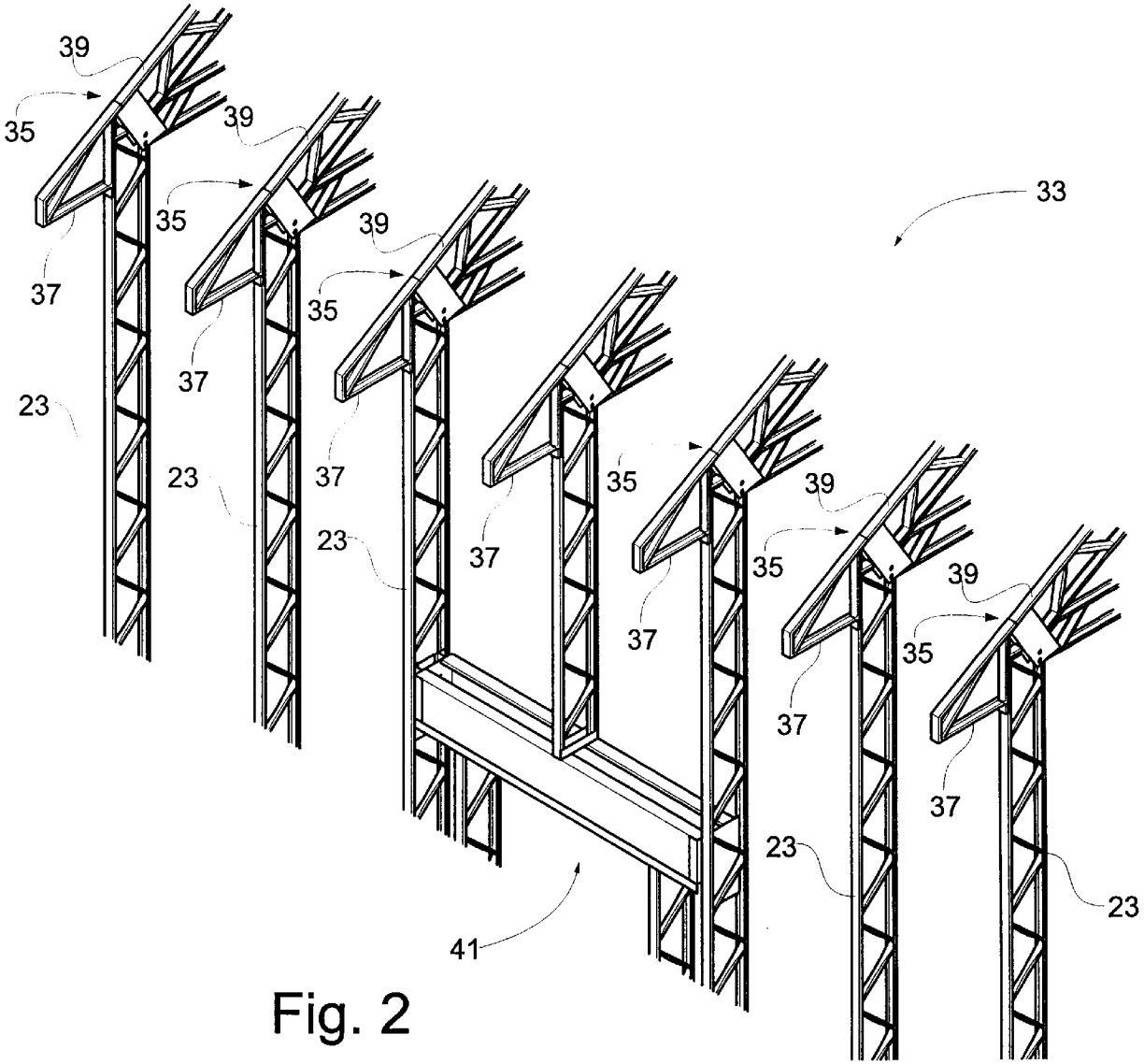
FIG. 2 is a perspective view showing eave connection assemblies of the preferred embodiment of the present invention installed in a structural frame of a building.

FIG. 2 illustrates a portion of a structural frame 33 of a building in which eave connection assemblies 35 of the present invention have been incorporated. A series of sidewall studs 23 form a wall frame 34, and as will be described in greater detail presently, each eave connection assembly 35 joins together one of the sidewall studs 23, a corresponding eave bracket 37, and a corresponding truss 39 in such a way that provides for selective vertical positioning of the truss 39 and the eave bracket 37 on the sidewall stud 23. The eave connection assembly 35 does not include a conventional splice connection, and therefore eliminates the particular components and construction steps involved in the use of such a splice connection. Also illustrated in FIG. 2 are a header connection assembly 41, the details of which are disclosed in my co-pending application Ser. No. 08/909,400, and which do not form part of the present invention.

Figure 3:
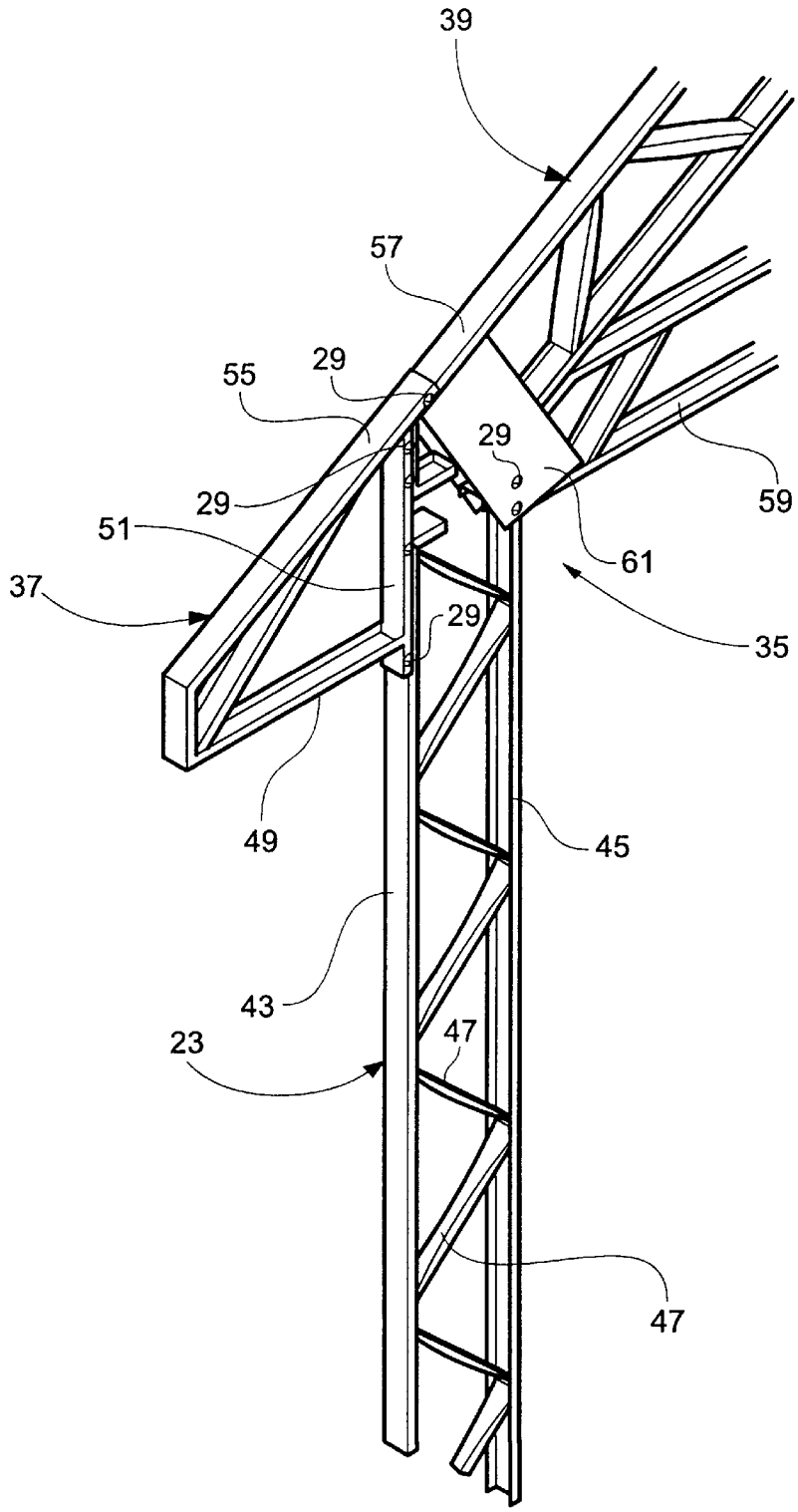
FIG. 3 is a perspective view of one of the eave connection assemblies illustrated in FIG. 2.

In FIG. 3, a single eave connection assembly 35 is shown with the sidewall stud 23 having an outer member 43 and an inner member 45, both of which are formed from metal channels. The sidewall stud 23 also has a web portion 47 formed from metal struts which extend in alternate directions between the stud outer member 43 and the stud inner member 45. It will be understood that the outer member 43, the inner member 45, and the web portion 47 may also be formed from wood or other appropriate materials without departing from the scope of the present invention.

The eave bracket 37 is installed so as to create an overhanging eave portion 49 which extends outwardly from the stud outer member 43, to thereby create a sheltered area under the eave bracket 37, as is customary in residential construction. The eave bracket 37 includes a vertically extending post 51 which is preferably formed from a metal channel, and which receives an end member 53 (see FIGS. 4 and 5) of the truss 39 and the outer member 43 of the sidewall stud 23 for fastening thereto by threaded fasteners 29. A top channel 55 of the eave bracket 37 receives a top chord 57 of the truss 39, and is attached thereto by threaded fasteners 29.

The truss 39 also includes a bottom chord 59 and a pair of haunch plates 61 which, in the preferred embodiment, are attached to the bottom chord 59 and the top chord 57 by welding, although other appropriate means of attachment, such as threaded fasteners, rivets, or the like, may be used. In addition, the truss 39 may be constructed from wooden members or other components without departing from the scope of the present invention.

The haunch plates 61 are arranged in parallel spaced relation (see FIGS. 5 and 6) so as to create a recess within which the inner member 45 of the sidewall stud 23 can be received. The haunch plates 61 are attached to the inner member 45 by threaded fasteners 29, or other appropriate arrangement.

As is conventional, the truss 39 may have two ends, with the top chord 57 and the bottom chord 59 extending between the ends. In accordance with a preferred embodiment of the present invention, an identical eave connection assembly 35 is provided at each of the ends of the truss 39, with each truss end having an identical end member 53 and haunch plate 61 as described above, and the end member 53 and the haunch plate 61 at each end being connected to an identical eave bracket 37 and sidewall stud 23 as described above. With this arrangement, the sidewall stud 23 at one of the ends is a first sidewall stud, and the sidewall stud 23 at the other end is a second sidewall stud. The first sidewall stud and the second sidewall stud are spaced apart from each other with the outer members 43 of the first and second sidewall studs spaced apart by a first distance and the inner members 45 of the first and second sidewall studs spaced apart by a second distance less than the first distance. Eave connections can be formed at each of the ends of the truss 39 as described above.

Where a series of such trusses 39 are attached at one end to a series of sidewall studs 23 and eave brackets 37 as shown in FIG. 2, the other ends of the trusses 39 will be identically attached to another series of corresponding sidewall studs 23 and eave brackets 37 to form a second wall frame (not shown). Each of the trusses 39 and eave brackets 37 can be independently selectively vertically positioned on their corresponding sidewall studs 23 so as to compensate for variations in the height of the sidewall studs 23.

Figure 4:
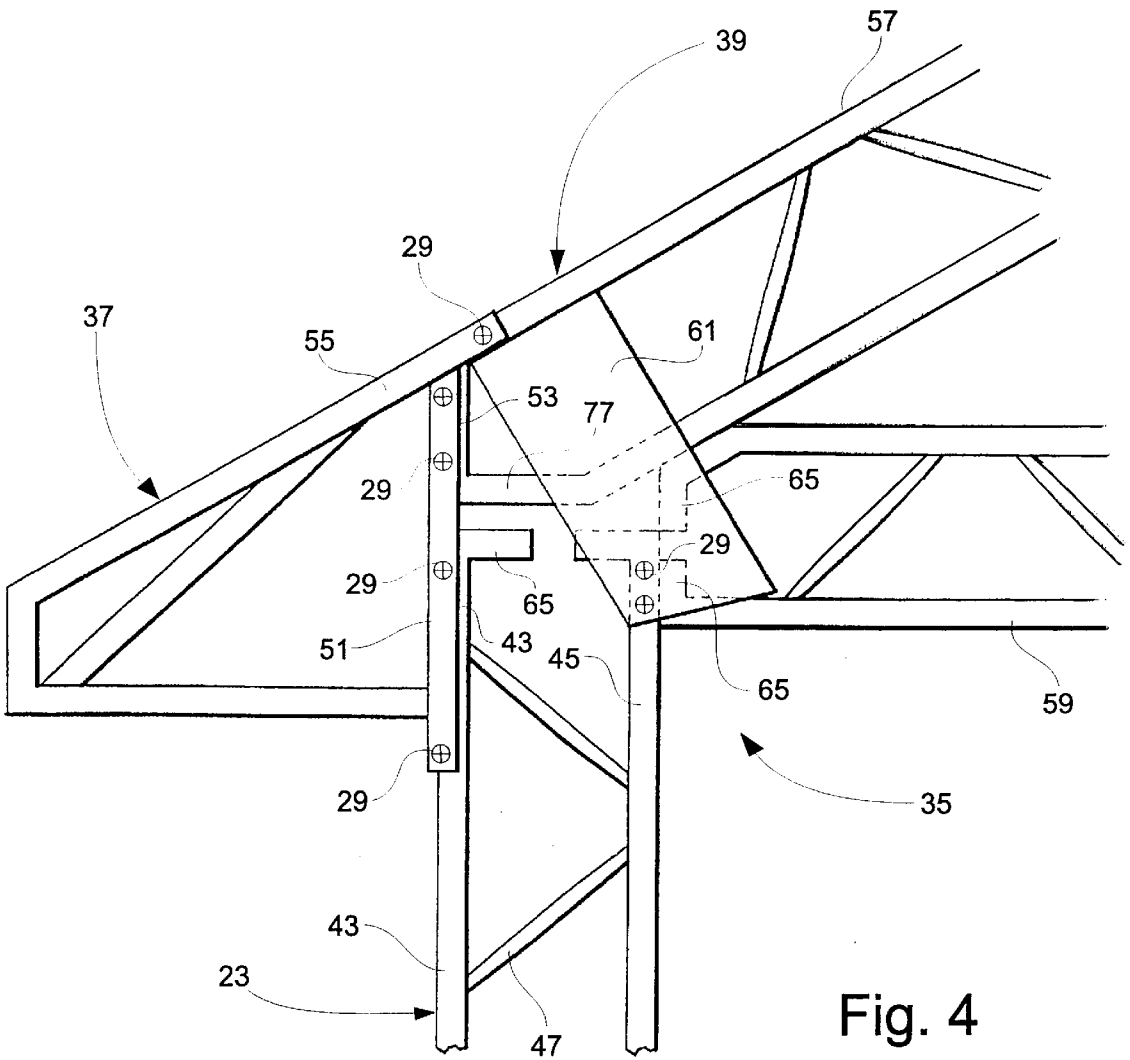
FIG. 4 is an elevational view of the eave connection assembly of FIG. 3.

FIG. 4 shows the eave connection assembly 35 of the present invention in an elevational view which illustrates the top chord 57 of the truss 39 received in the top channel 55 of the eave bracket 37, and the end member 53 of the truss 39 received in the post 51 of the eave bracket 37. The outer member 43 of the sidewall stud 23 can be seen received in the post 51, and the inner member 45 is received in the recess created by the two haunch plates 61. The position of the post 51 on the stud outer member 43 can be selectively varied along a vertical extent of the post 51, and the vertical position of the haunch plates 61 on the inner member 45 can likewise be selectively varied, so that a range of vertical adjustment (see FIGS. 6–9) is available to vary the vertical position of the truss 39 and the eave bracket 37 on the sidewall stud 23 to compensate for the aforementioned variations in foundation height or other irregularities.

Figure 5:
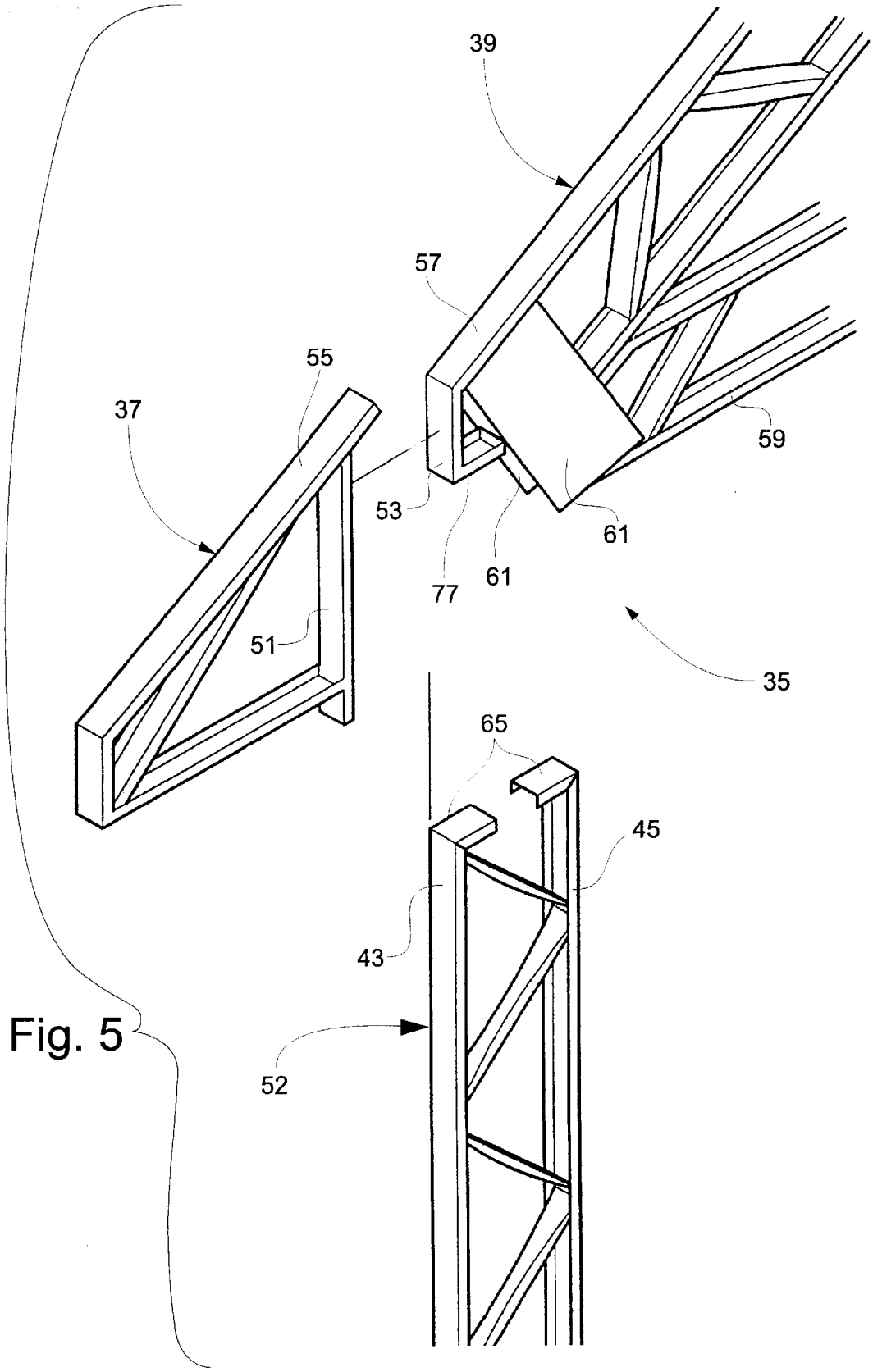
FIG. 5 is an exploded view of the eave connection assembly of FIG. 3.

In FIG. 5, the eave connection assembly 35 is shown in exploded form, and the bent end 65 of the outer stud member 43 and the inner stud member 45 can be seen. The bent ends 65 assist in fitting the outer stud member 43 into the channel configuration of the post 51, and in fitting the inner stud 45 member into the recess between the pair of haunch plates 61 by eliminating any protruding ends which might interfere with such fit. The members of the truss 39 may also have free ends which are bent to promote easy and close fitting of the inner stud member 45 between the haunch plates 61 and adjacent the bottom truss chord 59.

Figure 6:
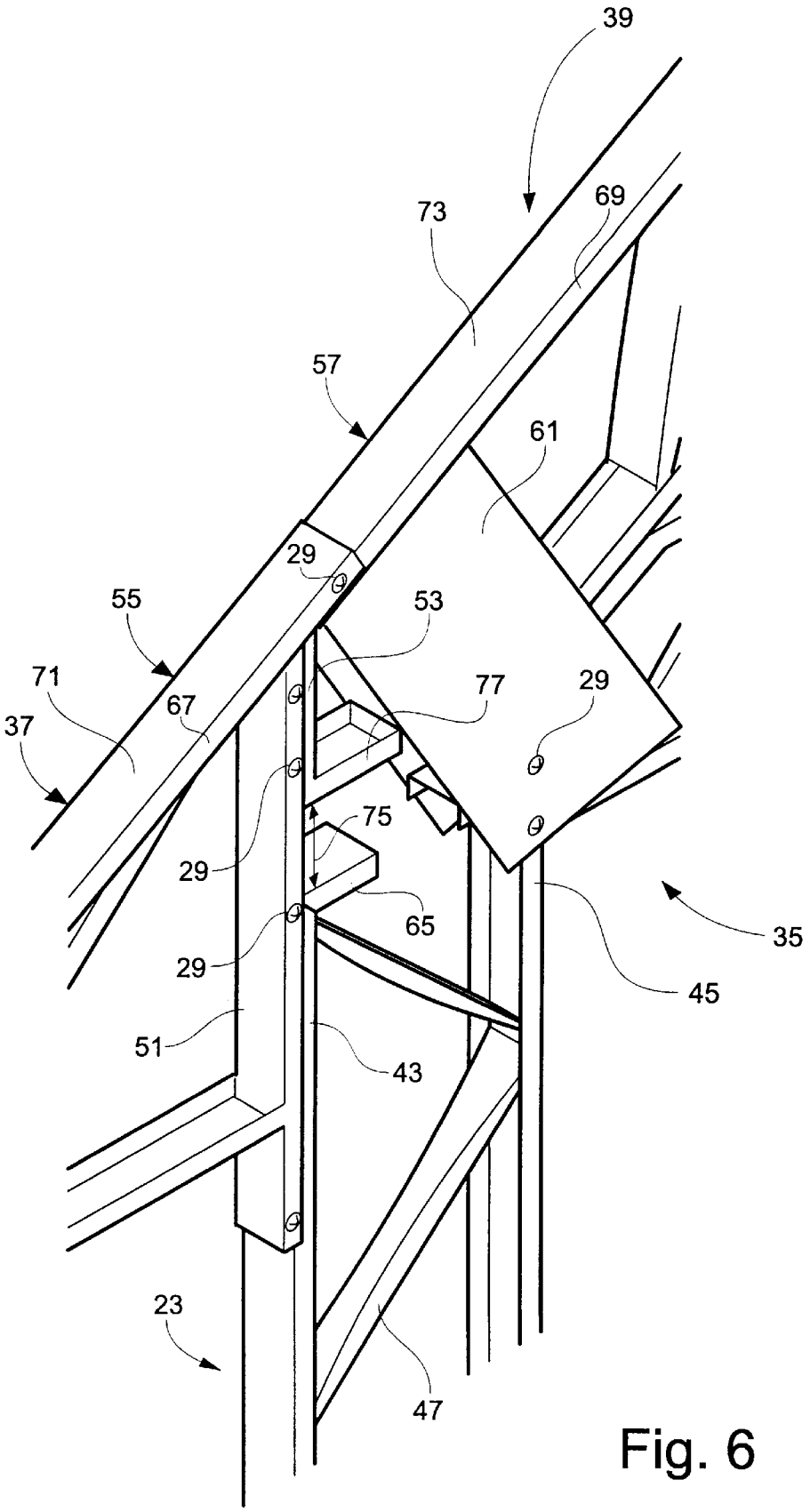
FIG. 6 is an enlarged perspective view of the eave connection assembly of FIG. 3.

FIG. 6 illustrates, in a detailed view, the eave connection assembly 35 of the present invention. The top channel 55 has two downwardly depending flanges 67, which receive the top chord 57 and its two downwardly depending flanges 69 therebetween. Threaded fasteners 29 are fastened through the top channel flanges 67 into the top chord flanges 69, although other fastening arrangements can also be employed. A top web surface 71 of the top channel 55, and a top web surface 73 of the truss top chord 57 are thereby left free of fasteners or other protruding irregularities, so that roof decking or other structural components can be directly attached to the top web surface 71 and the top web surface 73 without requiring use of purlins or other arrangements.

FIG. 6 also illustrates the approximate range of vertical adjustment for the eave bracket 37 and the truss 39 on the sidewall stud 23, as shown by arrow 75. The eave connection 35 of the present invention thus provides for adjustable positioning of the eave bracket 37 and the truss 39 within the range depicted by the arrow 75. A truss bent end 77 is provided to abut against the bent end 65 of the outer stud member 43 at the lowest position of the eave bracket 37 and the truss 39 on the sidewall stud 23.

Figure 9:
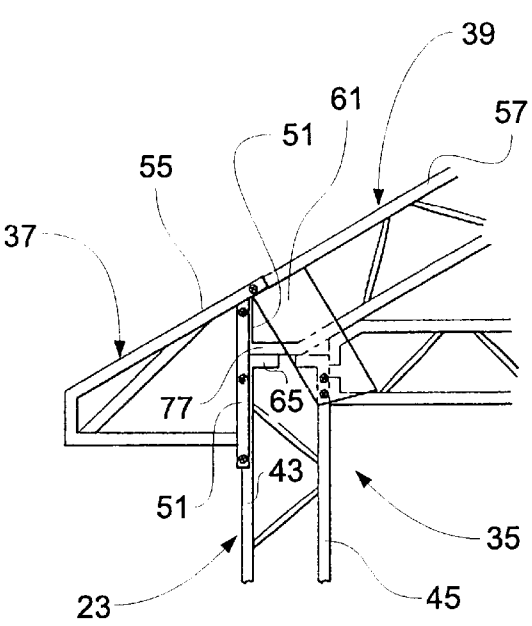
FIG. 9 is an elevational view of the eave connection assembly of FIG. 3 showing the sidewall stud and the truss and eave bracket in yet another selected vertical position.
Figure 8:
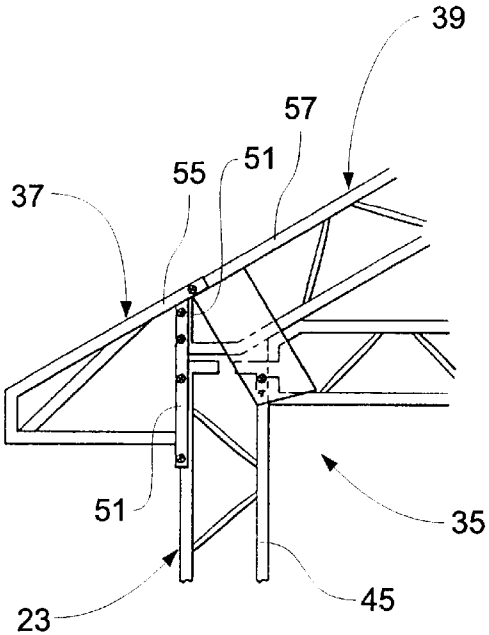
FIG. 8 is an elevational view of the eave connection assembly of FIG. 3 showing the sidewall stud and the truss and eave bracket in another selected vertical position.
Figure 7:
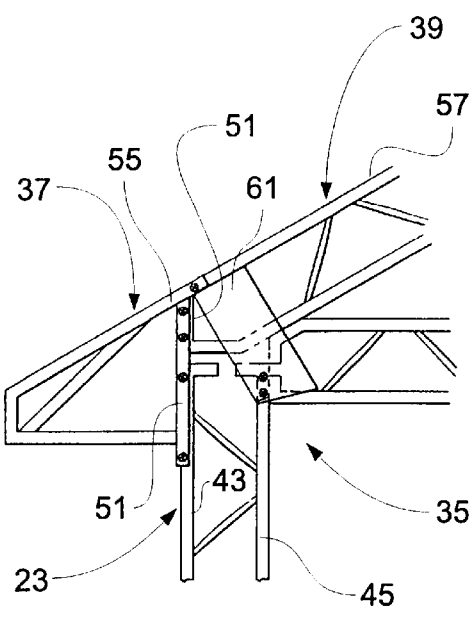
FIG. 7 is an elevational view of the eave connection assembly of FIG. 3 showing the sidewall stud and the truss and eave bracket in a first selected vertical position.

In FIGS. 7–9, three of the possible arrangements for relative vertical positioning of the eave bracket 37, the truss 39, and the sidewall stud 23 are shown. In FIG. 7, the eave bracket 37 and the truss 39 are shown in a relatively high vertical position spaced from the sidewall stud 23. The outer stud member 43 is positioned along the vertical extent of the channel of the post 51 at the desired position, and the inner stud member 45 is positioned along the vertical extent of the haunch plates 61 and in the recess between the haunch plates 61 again at the desired position. The top chord 57 of the truss 39 is received in the top channel 55 of the eave bracket 37, and the end member 53 of the truss 39 is received within a portion of the vertical extent of the post 51. Threaded fasteners 29 are used to attach the components of the eave connection assembly 35 to each other as described above.

In FIG. 8, the eave bracket 37 and the truss 39 are shown at a slightly lower position, with the position of the outer stud member 43 and the post 51, and the position of the inner stud member 45 along the vertical extent of the plates 61, being slightly modified so as to give rise to the desired positioning.

In FIG. 9, the eave bracket 37 and the truss 39 are shown at their lowest position with respect to the sidewall stud 23, and which the sidewall stud bent end 65 buts against the truss bent end 77. Once again, the position of the outer stud member 43 with respect to the post 51, and the position of the inner stud member 45 with respect to the haunch plate 61 have been adjusted so as to put the eave bracket 37 and the truss 39 in the desired vertical position with respect to the sidewall stud 23.

Figure 10:
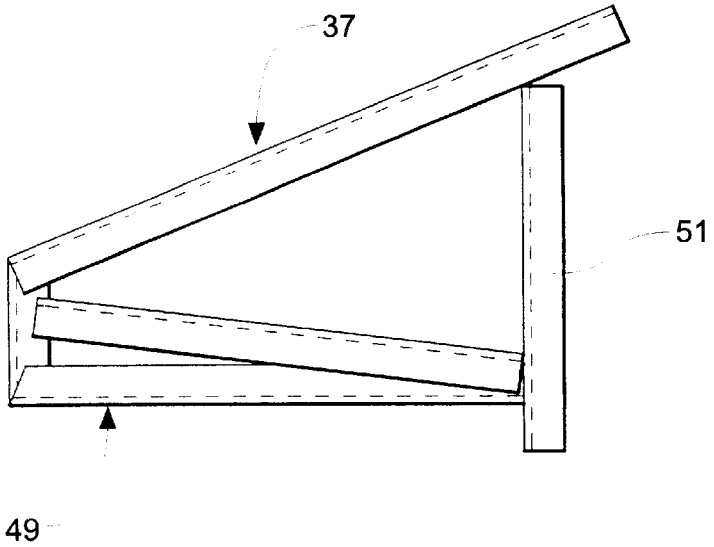
FIG. 10 is an elevational view of an alternative eave bracket of the present invention having alternative selected pitch and proportions.
Figure 11:
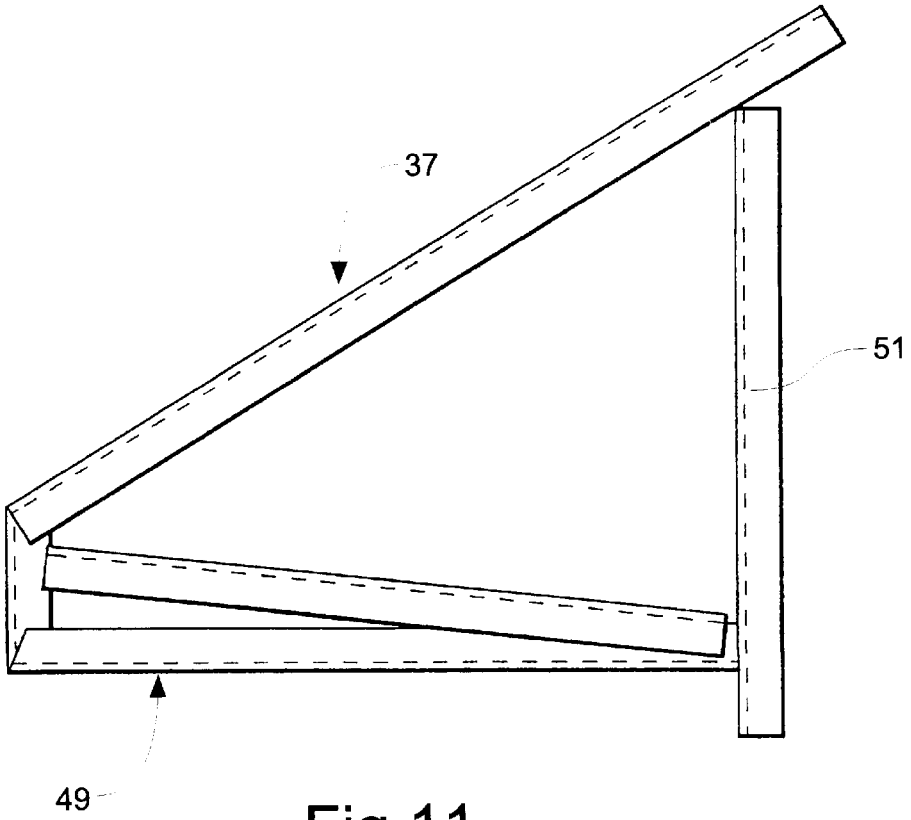
FIG. 11 is an elevational view of another eave bracket of the present invention having further selected pitch and proportions.

The eave connection assembly 35 of the present invention can be embodied in a wide variety of configurations to suit different applications. As shown in FIGS. 10 and 11, the eave bracket 37 can be formed to fit different roof pitches and to provide different proportions for the overhanging eave portion 49. FIG. 10 shows an eave bracket 37 configured for installation with a roof having a 5/12 pitch, while FIG. 11 shows an eave bracket 37 configured for installation with a roof having a 7/12 pitch. Moreover, the dimensions of the post 51 and the other structural members of the eave bracket 37 can be varied so as to create overhanging eave portions 49 which are of greater or lesser extent, as desired or required by particular applications.

The eave connection assembly 35 of the present invention not only provides simple adjustment of the vertical position of the eave bracket 37 and the truss 39, but can also be easily installed in the structural frame of a building. Once the sidewall stud 23 has been anchored in a foundation (not shown) and construction has progressed to the point where installation of roof trusses is appropriate, the truss 39 is moved into position above the sidewall stud 23 through use of a crane or other appropriate arrangement. The inner stud member 45 can be readily positioned within the recess formed by the pair of haunch plates 61, and the insertion of the inner stud member therein effectively holds the truss 39 and the sidewall stud 23 in the generally-desired position. It should be noted that the conventional splice connection 21 can require that the sidewall stud 23 be braced or otherwise held in position while additional components in the form of the splicing channels 27 are installed to attach the truss leg 25 to the sidewall stud 23. The eave connection 35 of the present invention does not require the use of such splicing channels 27.

Once the inner stud member 45 is received between the haunch plates 61 so as to generally align the sidewall stud 23 and the truss 39, the truss can be positioned at its exact desired height to compensate for the aforementioned foundation variations or irregularities. Attachment of the truss 39 to the sidewall stud 23 is easily accomplished through use of threaded fasteners 29 driven through the haunch plates 61 into the inner stud member 45. The eave bracket 37 can be attached to the truss 39 and the sidewall stud 23 at the same general time, and such attachment is accomplished by positioning the top channel 55 to receive the top chord 57, and positioning the post 51 to receive the truss end member 53 and a portion of the outer stud member 43. Attachment of these members is likewise easily accomplished through the use of threaded fasteners 29.

Once the eave connection assembly 35 of the present invention has been joined together, it will provide a rigid structural connection having several advantages. The eave connection assembly of the present invention allows the aforementioned selective vertical positioning of the truss and the eave bracket to be accomplished as part of the connection of the eave bracket 37 to the truss 39 and the sidewall stud 23, and does not require an additional assembly step nor additional components.

The eave connection assembly can also be quickly and easily joined together to produce a strong connection with an advantageous overhanging eave portion. Moreover, roof decking can be attached directly to the upper surfaces of the truss and the eave bracket, without the use of purlins or other arrangements.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An eave connection assembly for a structural frame for a building which structural frame includes a vertically extending sidewall stud having an outer vertical member and an inner vertical member, the eave connection assembly comprising:

a truss having an end portion including a generally vertically extending end member and a haunch plate secured to said end portion and having a predetermined vertical extent for attachment to the inner vertical member of the sidewall stud at a selective vertical position;

an eave bracket having a generally vertically extending post having a predetermined vertical extent attached to said end member along a portion of said vertical extent of said post and for attachment to the outer vertical member of the sidewall stud along another portion of said vertical extent of said post at a selective vertical position;

means for attaching said post to said end member of said truss and to the outer vertical member of the sidewall stud at said selective vertical position, and for attaching said haunch plate to the inner vertical member of the sidewall stud at said selective vertical position, whereby an eave connection is formed and said truss and said eave bracket are capable of being selectively vertically positioned on the sidewall stud.

2. The eave connection assembly of claim 1, wherein said truss includes a top chord extending from said end portion and said eave bracket includes a top channel formed to engage said top chord in overlapping relation, and further including means for attaching said top channel to said top chord.

3. The eave connection assembly of claim 2, wherein said top channel includes two downwardly depending flanges for receiving said top chord therebetween, and said means for attaching said top channel to said top chord fastens said flanges to said top chord.

4. The eave connection assembly of claim 1, wherein said truss includes a top chord and a bottom chord and said haunch plate is secured on said top chord and said bottom chord.

5. The eave connection assembly of claim 1, wherein said top chord is a channel member having two downwardly depending flanges, and said haunch plate is received within said top chord flanges.

6. The eave connection assembly of claim 1, wherein said truss includes a second haunch plate secured to said end portion and having a predetermined vertical extent for attachment to the inner vertical member of the sidewall stud at a selective vertical position, said haunch plates being mounted in generally parallel spaced relation to define a recess therebetween for receiving the inner vertical member of the sidewall stud therein, and further including means for attaching said second haunch plate to the inner vertical member at said selective vertical position.

7. The eave connection assembly of claim 1, wherein said means for attaching comprises threaded fasteners.

8. The eave connection assembly of claim 1, wherein said end member is a channel member and said post is a channel member receiving said end member and for receiving said outer vertical member of said sidewall stud.

9. The eave connection assembly of claim 1, wherein the structural frame further includes a second vertically extending sidewall stud having an outer vertical member and an inner vertical member, the studs being spaced from each other with the outer vertical members of the two studs being spaced apart by a first distance and the inner vertical members of the two studs being spaced apart by a second distance less than the first distance, said eave connection assembly further comprising a second end portion, with said end portions being opposed, said second end portion having an end member and a haunch plate secured to said second end portion and having a predetermined vertical extent for attachment to the inner vertical member of the second sidewall stud at a selective vertical position, and further including a second eave bracket having a generally vertically extending post having a predetermined vertical extent for attachment to said end member of said second end portion along a portion of said vertical extent of said post of said second eave bracket and for attachment to the outer vertical member of the second sidewall stud along another portion of said vertical extent of said post of said second eave bracket at a selective vertical position, and means for attaching said post of said second eave bracket to said end member of said second end portion of said truss and to the outer vertical member of said second sidewall stud at said selective vertical position, and for attaching said haunch plate of said second end portion of said truss to the inner vertical member of the second sidewall stud at said selective vertical position, whereby eave connections are formed and said truss and said eave brackets are capable of being selectively vertically positioned on the sidewall studs.

10. The eave connection assembly of claim 1, wherein the structural frame further includes a plurality of the vertically extending sidewall studs spaced and aligned to form a portion of a frame for a wall of the building, said eave connection assembly further comprising a plurality of corresponding ones of said trusses and said eave brackets for forming a plurality of the eave connections with the sidewall studs, and means for attaching said post of each of said eave brackets to said end member of said corresponding truss and to the outer vertical member of the outer vertical member of the corresponding sidewall stud at said selective vertical position, and for attaching said haunch plate of each of said trusses to the inner vertical member of the corresponding sidewall stud at said selective vertical position, whereby each of said trusses and the corresponding one of said eave brackets are capable of being independently selectively vertically positioned on the corresponding sidewall stud.

11. A structural assembly comprising:

a truss having an end portion including a generally vertically extending end member and a haunch plate secured to said end portion and having a predetermined vertical extent;

an eave bracket having a generally vertically extending post having a predetermined vertical extent attached to said end member along a portion of said vertical extent;

a vertically extending sidewall stud including an outer vertical member and an inner vertical member; said outer vertical member being attached to said post at a selective vertical position along another portion of said vertical extent of said post, and said inner vertical member being attached to said haunch plate at a selective vertical position along said vertical extent of said haunch plate;

means attaching said post to said end member and to said outer member of said sidewall stud at said selective vertical position, and attaching said haunch plate to said inner vertical member of said sidewall stud at said selective vertical position, whereby an eave connection is formed and said sidewall stud is selectively vertically positioned therein.

12. The structural assembly of claim 11, wherein said truss includes a top chord extending from said end portion and said eave bracket includes a top channel formed to engage said top chord in overlapping relation, and further including means for attaching said top channel to said top chord.

13. The structural assembly of claim 12, wherein said top channel member includes two downwardly depending flanges receiving said top chord therebetween, and said attaching means fastens said flanges to said top chord.

14. The structural assembly of claim 11, wherein said truss includes a top chord and a bottom chord and said haunch plate is secured on said top chord and said bottom chord.

15. The structural assembly of claim 11, wherein said top chord is a channel member having two downwardly depending flanges and said haunch plate is received within said top chord flanges.

16. The structural assembly of claim 11, wherein said truss includes a second haunch plate secured to said end portion and having a predetermined vertical extent attached to the inner vertical member of the sidewall stud at a selective vertical position, said haunch plates being mounted in generally parallel spaced relation to define a recess therebetween receiving the inner vertical member of the sidewall stud therein, and further including means attaching said second haunch plate to the inner vertical member at said selective vertical position.

17. The structural assembly of claim 11, wherein said outer vertical member and said inner vertical member are formed from channel members, and said sidewall stud includes a web portion intermediate said channel members.

18. The structural assembly of claim 11, wherein said means for attaching comprises threaded fasteners.

19. The structural assembly of claim 11, wherein said end member is a channel member and said post is a channel member receiving said end member and said outer vertical member of said sidewall stud.

20. The structural assembly of claim 11, wherein said truss includes a second end portion, with said end portions being opposed, said second end portion having an end member and a haunch plate secured to said second end portion and having a predetermined vertical extent, and further including a second eave bracket having a generally vertically extending post having a predetermined vertical extent and attached to said end member of said second end portion along a portion of said vertical extent of said post of said second eave bracket, and a second vertically extending sidewall stud having an outer vertical member and an inner vertical member, said sidewall studs being spaced from each other with said outer vertical members of the two studs being spaced apart by a first distance and said inner vertical members of the two studs being spaced apart by a second distance less than the first distance, said outer vertical member of said second sidewall stud being attached to said post of said second eave bracket at a selective vertical position along another portion of said vertical extent of said post of said second eave bracket, and said inner vertical member of said second sidewall stud being attached to said haunch plate of said second end portion at a selective vertical position along said vertical extent of said haunch plate of said second end portion, and means attaching said post of said second eave bracket to said end member of said second end portion of said truss and to said outer vertical member of said second sidewall stud at said selective vertical position, and attaching said haunch plate of said second end portion to said inner vertical member of the second sidewall stud at said selective vertical position, whereby eave connections are formed and said truss and said eave brackets are selectively vertically positioned on said sidewall studs.

21. The structural assembly of claim 11, further including a plurality of said trusses and a plurality of corresponding said eave brackets and said sidewall studs, said sidewall studs being spaced and aligned to form a portion of a structural frame for a wall of the building, and means attaching said post of each of said eave brackets to said end member of said corresponding trusses and to said outer vertical member of said corresponding sidewall studs at said selective vertical position, and attaching said haunch plate of each of said trusses to said inner vertical member of said corresponding sidewall stud at said selective vertical position, whereby each of said trusses and the corresponding one of said eave brackets are independently selectively vertically positioned on the corresponding said sidewall stud.

22. A structural assembly for forming eave connections in a structural frame for a building which structural frame includes a pair of vertically extending sidewall studs each having an outer vertical member and an inner vertical member, the sidewall studs being arranged spaced from each other with the outer vertical members of the pair of studs being spaced apart by a first distance and the inner vertical members of the pair of studs being spaced apart by a second distance less than the first distance, the structural assembly comprising:

a truss having two opposed end portions and a top chord extending between said end portions, each of said end portions including an end member having a predetermined vertical extent and a pair of haunch plates mounted in generally parallel spaced relation and defining a notch of predetermined vertical extent for receiving one of the inner vertical members of the sidewall studs at a selective vertical position therein;

a pair of eave brackets each having a top channel formed to receive said top chord of said truss, and a generally vertically extending post channel having a predetermined vertical extent for attachment to one of said end members along a portion of said vertical extent of said post channel and for attachment to one of the outer vertical members of the sidewall studs along another portion of said vertical extent of said post channel at a selective vertical position;

means for attaching each of said top channels to said top chord, each of said post channels to said respective one of said end members of said truss and to the respective one of the outer vertical members of the sidewall studs at said respective selective vertical position, and each of said haunch plates to said respective one of the inner vertical members of the sidewall studs at said respective selective vertical position, whereby eave connections are formed and said truss and said eave brackets are capable of being selectively vertically positioned on the sidewall studs.

23. The structural assembly of claim 22, wherein the structural frame further includes a first plurality of the vertically extending sidewall studs spaced and aligned to form a portion of a first wall frame of the building and a second plurality of the vertically extending sidewall studs spaced and aligned to form a portion of a second wall frame of the building, and said structural assembly further comprising a plurality of corresponding ones of said trusses and said eave brackets for forming a plurality of the eave connections with the first and second pluralities of sidewall studs, and means for attaching said top channel of each of said eave brackets to said top chord of said corresponding truss, for attaching said post channel of each of said eave brackets to one of said end members of said corresponding truss and to the outer vertical member of the corresponding sidewall stud at said selective vertical position, and for attaching each of said haunch plates of each of said trusses to the inner vertical member of the corresponding sidewall stud at said selective vertical position, whereby each of said trusses and the corresponding eave brackets are capable of being independently selectively vertically positioned on the corresponding sidewall studs of the first and second wall frames.

* * * * *